United States Patent [19]

Hayase

[11] Patent Number: 4,723,895

[45] Date of Patent: Feb. 9, 1988

[54] METHOD OF AND APPARATUS FOR EFFECTING VOLUME CONTROL OF COMPRESSOR

[75] Inventor: Isao Hayase, Katsuta, Japan

[73] Assignee: Hitachi, Ltd., Tokyo, Japan

[21] Appl. No.: 774,704

[22] Filed: Sep. 11, 1985

Related U.S. Application Data

[63] Continuation of Ser. No. 576,903, Feb. 3, 1984, abandoned.

[30] Foreign Application Priority Data

Feb. 4, 1983 [JP] Japan ..... 58-16034
Feb. 25, 1983 [JP] Japan ..... 58-29418

[51] Int. Cl.[4] ..... F04B 21/02; F04B 29/00; F04B 49/00

[52] U.S. Cl. ..... 417/293; 417/295; 417/442; 417/462; 417/503

[58] Field of Search ..... 417/293, 295, 441, 462, 417/463, 503, 442

[56] References Cited

U.S. PATENT DOCUMENTS

| | | | |
|---|---|---|---|
| 1,910,876 | 5/1933 | Appel | 417/462 |
| 1,988,296 | 1/1935 | Blume et al. | 417/295 |
| 2,191,345 | 2/1940 | Gaede | 417/295 |
| 3,048,022 | 8/1962 | Clary | 417/293 |
| 4,452,570 | 6/1984 | Fujisaki et al. | 417/295 |
| 4,515,066 | 5/1985 | Ito et al. | 91/459 |

FOREIGN PATENT DOCUMENTS

| | | |
|---|---|---|
| 45933 | 2/1982 | European Pat. Off. . |
| 59834 | 9/1982 | European Pat. Off. . |
| 453693 | 9/1936 | United Kingdom . |
| 968087 | 8/1964 | United Kingdom . |
| 1501474 | 2/1978 | United Kingdom . |

*Primary Examiner*—John J. Vrablik
*Attorney, Agent, or Firm*—Antonelli, Terry & Wands

[57] ABSTRACT

A method of and an apparatus for effecting volume control suitable for use with a compressor for compressing a compressible fluid, such as a refrigerant of the refrigeration cycle, wherein a suction fluid is forcedly closed while a suction step is being performed and the fluid drawn up to then by suction into each working chamber is subjected to adiabatic expansion during the rest of the suction stroke. The fluid in the working chamber subjected to adiabatic expansion is then subjected to adiabatic compression in initial stages of a compression stroke following the suction stroke only for a period corresponding to the period of the adiabatic expansion. An on-off control valve is mounted in a fluid suction passage and operative to be brought, when it is necessary to effect volume control, to a closed position while the suction stroke is being performed, to thereby interrupt the flow of the fluid through the fluid suction passage to the working chamber.

10 Claims, 33 Drawing Figures

METHOD OF AND APPARATUS FOR EFFECTING VOLUME CONTROL OF COMPRESSOR

BACKGROUND OF THE INVENTION

This is a continuation of application Ser. No. 576,903 filed Feb. 3, 1984, abandoned.

This invention relates to compressors suitable for use in compressing a refrigerant in the refrigeration cycle, for example, and more particularly to a method of effecting volume control of a compressor and an apparatus suitable for carrying the method into practice in which the volume of a compressed fluid discharged from the compressor is controlled under predetermined conditions.

In one known method of controlling the volume of a compressed fluid discharged from a compressor, the cross-sectional area of a suction passage of the compressor is reduced depending on the operating conditions. When this method is used, the volume of a fluid introduced into a compression chamber is reduced in proportion to a reduction in the cross-sectional area of the suction passage, resulting in a reduction in the volume of the fluid discharged from the compressor. When the cross-sectional area of the suction passage is reduced, the resistance offered to the flow of the fluid by the passage would increase and the pressure in the compressor chamber would become lower than a predetermined pressure of the fluid drawn by suction through the suction passage, resulting in a performance of suction in a condition generally referred to as a negative pressure condition.

When this phenomenon takes place, the compressor would require an additional power input which is not required in a steady-state operation with no reduction in the cross-sectional area of the suction passage. Thus, overall adiabatic efficiency or energy efficiency would drop. Moreover, if the suction stroke takes place in this condition until the volume of the compression chamber is maximized, the fluid introduced into the compression chamber would show a rise in temperature in proportion to a reduction in the volume of the fluid introduced into the compression chamber achieved by reducing the cross-sectional area of the suction passage, thereby causing a rise in the temperature of the fluid discharged from the compressor.

SUMMARY OF THE INVENTION

An object of this invention is to provide a method of and an apparatus for controlling the volume of a fluid discharged from a compressor without causing a reduction in energy efficiency.

Another object is to provide a method of and an apparatus for controlling the volume of a fluid discharged from the compressor without causing a rise in the temperature of the discharged fluid.

Still another object is to provide a method of and an apparatus for effecting volume control suitable for application in a novel compressor representing an improvement in the prior art.

The outstanding characteristic of the invention enabling the aforesaid objects to be accomplished is that each working chamber is brought out of communication with a suction passage while it is in a suction stroke and before its volume is maximized, and the fluid already drawn into the working chamber is subjected to adiabatic expansion until its volume is maximized, when the working chamber is switched from the suction stroke to a compression stroke.

BRIEF DESCRIPTION OF THE DRAWINGS

FIG. 12 is a schematic view of an engine driving a compressor with a sensor for detecting rotational speed of the engine to control an operation of the compressor utilizing a motor actuator;

FIG. 13 is a schematic view of an engine driving a compressor with a timing control means for controlling the operation of a compressor utilizing a motor actuator;

FIG. 14 is a schematic view of an engine driving a compressor with a sensor for detecting rotational speed of the engine to control and operation of the compressor utilizing an electromagnetic solenoid actuator;

FIG. 15 is a schematic view of an engine driving a compressor with a timing control means for controlling an operation of the compressor utilizing an electromagnetic solenoid actuator;

FIG. 16 is a schematic view of an engine driving a compressor with a sensor for detecting rotational speed of the engine to control an operation of the compressor utilizing a diaphragm actuator; and FIG. 17 is a schematic view of an engine driving a compressor with a timing control means for controlling an operation of the compressor utilizing a diaphragm actuator.

DETAILED DESCRIPTION

A novel compressor suitable for carrying the method of effecting volume control according to the invention will be described by referring to the accompanying drawings.

Figure 1:
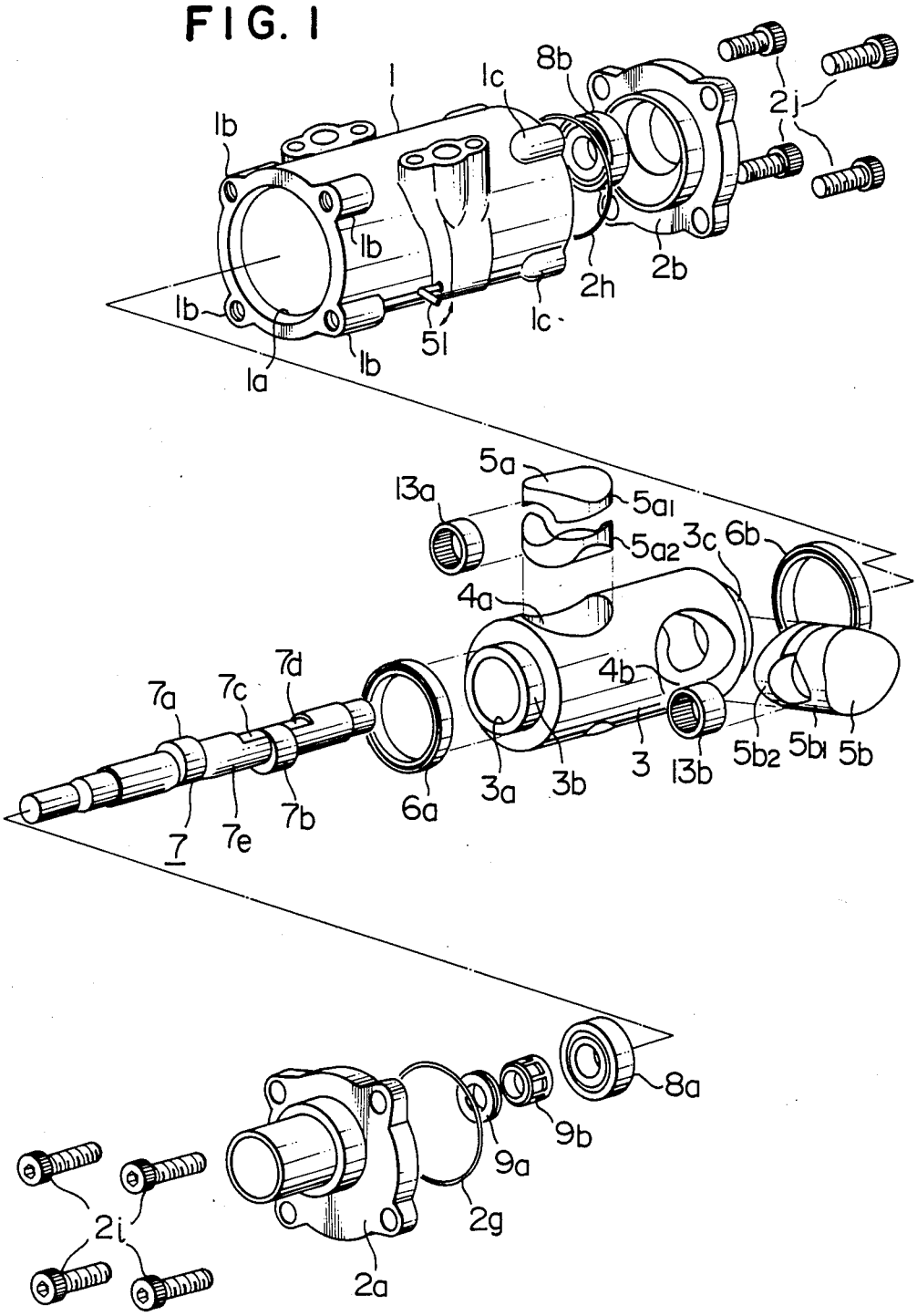
FIG. 1 is an exploded perspective view of a compressor in which the present invention can have application.

Referring to FIG. 1, a shell 1 for enclosing the machine parts defines a cylindrical space surrounded by a cylindrical wall surface 1*a*, with the shell 1 being closed at opposite ends thereof by side plates 2a, 2b, so that the space defined by the shell 1 is essentially a closed space.

A cylinder 3, inserted in the shell 1, is formed with two bores 4a, 4b disposed at right angles to each other. The bores 4a, 4b respectively receive therein double-head pistons 5a, 5b, the heads of which are machined in such a manner that they constitute parts of an outer circumferential surface of the cylinder 3 which is formed with an axial bore 3a for receiving a shaft 7. Annular protuberances 3b, 3c are formed integrally with the cylinder 3 at opposite ends thereof to have inner races of bearings 6a, 6b, respectively, secured thereto. Outer races of the bearings 6a, 6b are secured to inner peripheral surfaces of annular protuberances 2c, 2d formed at respective inner end faces of the side plates 2a, 2b.

The annular protuberances 2c, 2d of the side plates 2a, 2b are fitted at their outer peripheries in opposite ends of the cylindrical wall surface 1a of the shell 1, and seal rings 2g, 2h are mounted between the annular protuberances 2c, 2d, flanges 2e and 2f of the respective side plates 2a, 2b. The side plates 2a, 2b are respectively threadably connected to lugs 1b, 1c of the shell 1 by screws 2i, 2j, respectively, to provide a seal between the side plates 2a, 2b and the cylinder 1.

Figure 2:
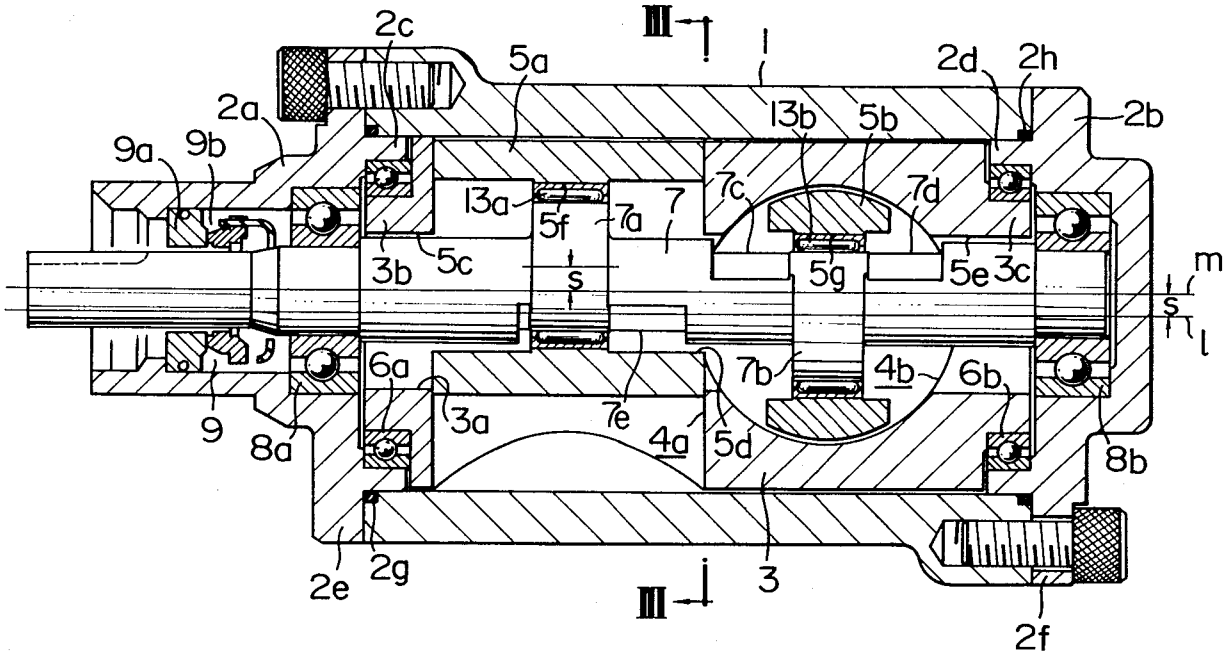
FIG. 2 is a sectional view of the compressor shown in FIG. 1.

Referring to FIG. 2, a dash-and-dot line l represents a center axis of the inner space of the shell 1 and a center axis of rotation of the cylinder 3. The center of rotation of the bearings 6a, 6b coincides with the center axis l.

Bearings 8a, 8b which are respectively located outwardly of the bearings 6a 6b, and the shell 3 have their inner races force fitted in the shaft 7 to bear the rotation thereof. The shaft 7 extends through the cylinder 3 axially thereof and is journalled at one end by the inner race of the bearing 8b and at an opposite end by the inner race of the bearing 8a. The opposite end of the shaft 7 extends through a shaft sealing chamber 9 formed in the side plate 2a outside of the compressor. A fixed ring 9a and a slider form a shaft sealing device.

Figure 3:
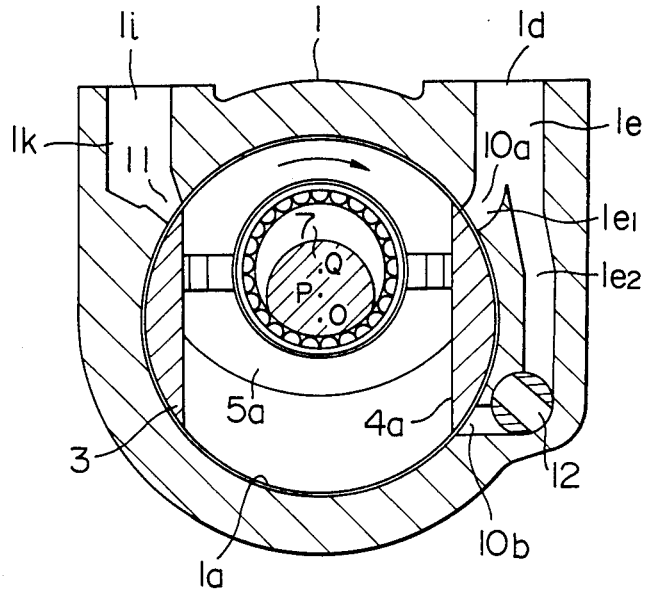
FIG. 3 is a sectional view taken along the line III—III in FIG. 2.

The shaft 7 has a center of rotation (having an axis m) which is displaced upwardly from the center of rotation (center axis l) of the cylinder 3 by distance S as shown in FIGS. 2 and 3. The axial bore 3a of the cylinder 3 for the shaft 7 to extend therethrough comprises irregular bore portions 5c–5e. The pistons 5a, 5b, slidably fitted in the bores 4a, 4b, are formed with openings 5f, 5g, respectively, for the shaft 7 to extend therethrough.

The shaft 7 is formed integrally with cams 7a, 7b in positions corresponding to axial central portions of the pistons 5a, 5b, respectively. The cams 7a, 7b are constructed such that they have protuberances in positions spaced apart from each other through a circumferential extent of 180 degrees and their centers are spaced apart from the center of rotation of the shaft 7 by a spacing interval S. The shaft 7 is fitted in the axial bore 3a of the cylinder 3 in such a manner that the cams 7a, 7b are rotatable in the openings 5f, 5g of the pistons 5a, 5b, respectively.

The principle of operation of the invention will now be described by referring to FIGS. 3, 4a–4e and 4a'–4e'.

In FIGS. 3, 4a–4e and 4a'–4e', O, P and Q designate the center of rotation of the cylinder 3, the center of rotation of the shaft 7, and the center point of the cams 7a, respectively.

The cylinder 3 and shaft 7 are journalled by the bearings 6a, 6b bearings 8a and 8b, respectively, for rotation in the shell 1, and their centers of rotation are fixed in position.

As the shaft 7 rotates in the direction of an arrow shown in each of FIGS. 3 and 4a–4e, the cam 7a exerts on the piston 5a a force which tends to move the piston 5a in a rightward direction in each figure. This force moves the piston 5a and the cylinder 3 as a unit in the same direction as the shaft 7.

Figures 4A, 4B, 4C, 4D, 4E:
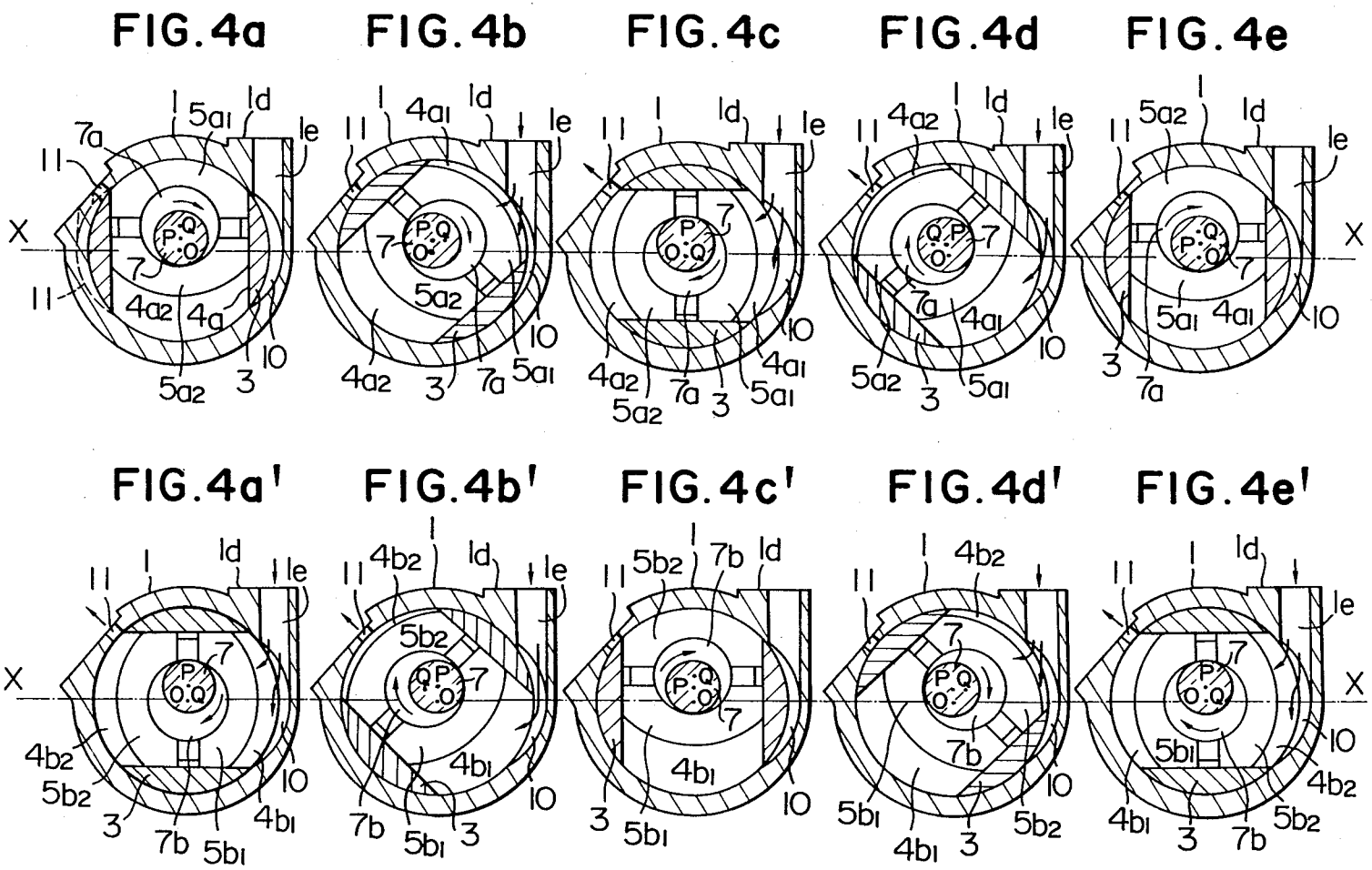
FIGS. 4*a*–4*e* and 4*a*′–4*e*′ are views in explanation of the principle of operation of the compressor shown in FIGS. 1–3.

FIG. 4b shows an axis extending through the center of rotation P of the shaft 7 and the center of rotation Q of the cams 7a, 7b forming an angle of 90 degrees with respect to a base line X after the shaft 7 has rotated through 90 degrees from the position shown in FIG. 4a. At this time, the center axis (extending through the points O and Q) of the cylinder bore 4a and the base line X form an angle of 45 degrees after the cylinder 3 has rotated through 45 degrees.

The piston 5a moves in sliding movement in the cylinder bore 4a along the center axis of the bore for a stroke of $(2-\sqrt{2})/4$ toward a piston $5a_2$ of the double-head piston 5a. This stroke is smaller than the eccentricity S of the cam 7a. As a result, in the cylinder bore 4a, a working chamber $4a_2$ defined by the head of the piston $5a_2$ and the shell 1 has its volume reduced by an amount proportional to the $(2-\sqrt{2})/4$ stroke of the piston 5a, to thereby compress a fluid in the working chamber $4a_2$.

At this time, the head of the piston $5a_1$ and the shell 1 define therebetween a working chamber $4a_1$ of a volume corresponding to the $(2-\sqrt{2})/4$ stroke of the piston 5a, and at the same time, a suction port 10 which has up to then been closed by the wall of the cylinder 3 opens into the working chamber $4a_1$ to allow a fluid to be introduced thereinto through an inlet port 1d and a passage 1e.

FIG. 4c shows the center Q of the cam 7a coinciding in position with the center of rotation O of the cylinder 3 after the shaft 7 has rotated through 180 degrees. At this time, the cylinder 3 has rotated through 90 degrees and the piston 5a has moved in the bore 4a for a distance corresponding to one-half stroke toward the working chamber $4a_2$ from the position shown in FIG. 4a. As a result, the fluid in the working chamber $4a_2$ is compressed to have its volume reduced by one-half and a fluid corresponding in volume to $(2+\sqrt{2})$ times the volume described by referring to FIG. 4b is drawn by suction into the working chamber $4a_1$.

At this time, the working chamber $4a_2$ is communicated with a discharge port 11 formed in the shell 1 to allow the compressed fluid to be discharged through the discharge port 11. The fluid thus discharged reaches through a passage 1h shown in FIG. 3 to an outlet port 1i.

Further rotation of the shaft 7 through 90 degrees brings the cylinder 3 to a position shown in FIG. 4d in which the piston 5a further reduces the volume of the working chamber $4a_2$ by an amount corresponding to a $(2-\sqrt{2})/4$ stroke while increasing the volume of the working chamber $4a_1$.

When the shaft 7 has rotated through 360 degrees to a position shown in FIG. 4e, the suction port 10 and discharge port 11 are both closed by the wall of the cylinder 3.

As a result, the working chamber $4a_1$ has its volume maximized when it is in the position shown in FIG. 4e. Since the pistons 5a, 5b move in a stroke of 2S each time the cylinder 3 rotates through 90 degrees, the pistons 5a, 5b have moved in a stroke of 4S when the cylinder 3 has rotated through 180 degrees to a position shown in FIG. 4e.

Further rotation of the shaft 7 results in the volume of the working chamber $4a_1$ decreasing and the volume of the working chamber $4a_2$ increasing, so that when the shaft 7 has rotated through 360 degrees back to the position shown in FIG. 4a, the working chambers $4a_1$, $4a_2$ have moved through a suction stroke and a compression stroke, respectively.

FIGS. 4a'–4e' show the manner of operation of the piston 5b. It will be seen that the piston 5b is advanced by 90 degrees of the rotational angle of the cylinder 3 with respect to the piston 5a. Thus, FIGS. 4a', 4b' and 4c' correspond to FIGS. 4c, 4d and 4e, respectively, and FIGS. 4d' and 4e' show conditions in which the piston 5b is advanced by 45 and 90 degrees, respectively, of the rotational angle of the cylinder 3 with respect to the piston 5a shown in FIG. 4e. Suction and compression of the fluid take place in the same manner as described by referring to FIGS. 4a–4e.

Referring to FIG. 2, outer races of bearings 13a, 13b are force fitted and secured in the openings 5f, 5g, respectively, formed in the pistons 5a, 5b for receiving the shaft 7. Thus, the pistons 5a, 5b are rotatably journalled by the bearings 13a, 13b, respectively, with respect to the cams 7a 7b. The cams 7a, 7b each have the following construction. The cam diameter is reduced without varying the eccentricity S by causing a portion diametrically opposed to the protuberance to be disposed in a position disposed nearer the center of the shaft 7 than its outer circumferential surface, and reliefs 7c–7e for assembling the pistons 5a and 5b with the shaft 7 are formed at the outer circumferential surface of the shaft 7 in the vicinity of the portion of the cams 7a, 7b diametrically opposed to the protuberances.

Assembling of the shaft 7 will now be described by referring to FIGS. 5a–5f. As shown, the bearings 13a, 13b are force fitted in the openings 5f, 5g as described hereinabove by reducing the diameter of openings formed in the pistons 5a, 5b for receiving the cams 7a, 7b therein. Thus, the inner diameter of the bearings 13a, 13b is equal to the outer diameter of the cams 7a, 7b.

In FIGS. 5a–5f, the shaft 7 is fixed and the pistons 5a, 5b are fitted in the bores 4a, 4b, respectively, of the cylinder 3, not shown. The shaft 7 is inserted at its end near the cam 7b in the bore portion 5c of the cylinder 3, and the cylinder 3 is then moved leftwardly in FIGS. 5a–5f.

Figure 5A:
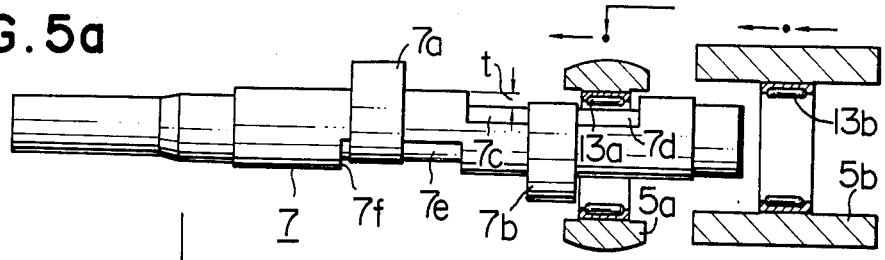
FIGS. 5*a*–5*f* are views in explanation of the steps followed in assembling the shaft.
Figure 5B:
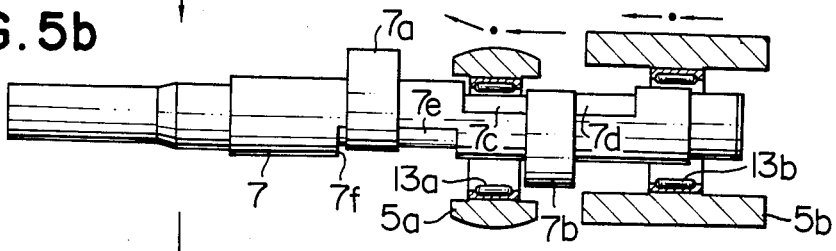
Figure 5C:
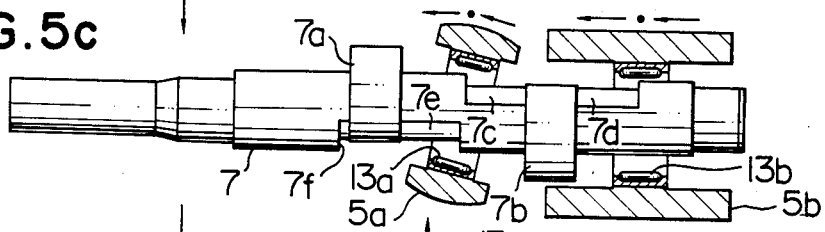
Figure 5D:
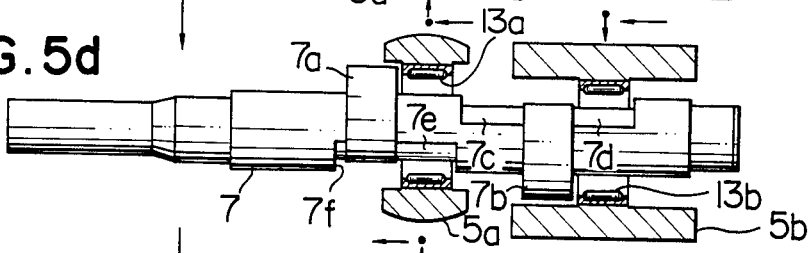

The cylinder 3 is moved in such a manner that when the piston 5a moves to a position corresponding to that of the relief 7d in FIG. 5a, the bearing 13a is positioned against the relief 7d. By moving the cylinder 3 in this condition leftwardly, as shown in FIG. 5b, the piston 5a can be moved past the cam 7b to a position corresponding to that of the relief 7c. Then, the cylinder 3 is moved further leftwardly while the piston 5a is moved clockwise. This brings the piston 5a to a position corresponding to that of the relief 7e and the piston 5b to a position corresponding to that of the relief 7d as shown in FIG. 5d.

Figure 5E:
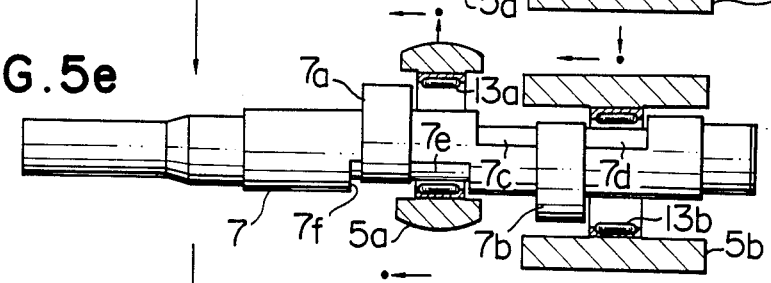
Figure 5F:
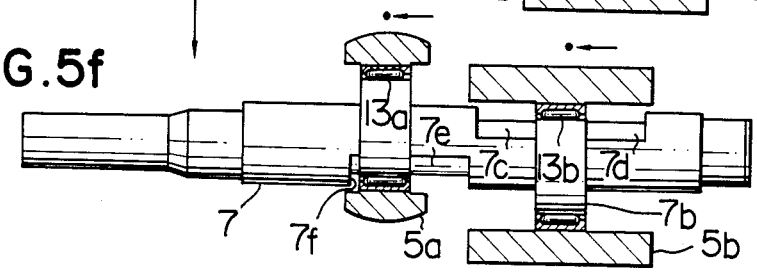

Now, the bearing 13a is brought into contact with the relief 7e as shown in FIG. 5e by moving the cylinder 3, not shown, upwardly, and the piston 5b is moved downwardly to bring the bearing 13b into contact with the relief 7d. By moving the cylinder 3 leftwardly while it is in this condition, the two pistons 5a and 5b can be fitted to the cams 7a, 7b, respectively, as shown in FIG. 5f.

As described hereinabove, assembling of the shaft 7 can be achieved by moving the cylinder 3 relative to the shaft 7 in one direction by leaving the shaft stationary. This is conducive to automation of the shaft assembling operation.

The advantage offered by the provision of the reliefs 7c, 7d will be described by referring to FIG. 5a. Suppose that no reliefs were provided. The cylinder 3 would be moved upwardly by a distance corresponding to a dimension t of the relief 7d in FIG. 5a. When this is the case, the bearing 13a would impinge on the protuberance of the cam 7b, thereby interrupting the leftward movement of the cylinder 3. It is essential that the reliefs 7c, 7d be provided to reduce the diameter of the openings formed in the pistons for receiving the cams.

One embodiment of the method of and apparatus for effecting volume control in conformity with the invention will be described as being applied to the improved compressor shown and described hereinabove by referring to FIGS. 1 to 5a–5f.

As shown in FIG. 3, the suction passage 1e branches into two passages $1e_1$, $1e_2$ which are respectively maintained in communication with a suction port 10a which is opened immediately after a suction stroke begins and a suction port 10b which is brought into communication with a working chamber when the suction stroke has progressed halfway. An on-off control valve 12 is mounted in the passage $1e_2$ communicated with the suction port 10b. The suction pasasge in communication with the cylinder bore 4b has the same construction as described hereinabove. By switching on and off the control valve 12, it is possible to effect control of the flow of a fluid through the fluid machine. The manner in which volume control is effected will be described by referring to FIGS. 6a–6f and 7a–7f.

FIGS. 6a–6f show the manner in which the compressor operates when the on-off control valve 12 is switched to a position in which it allows the fluid to flow freely therethrough in the passage $1e_2$.

Figures 6A, 6B, 6C, 6D, 6E, 7A, 7B, 7C, 7D, 7E:
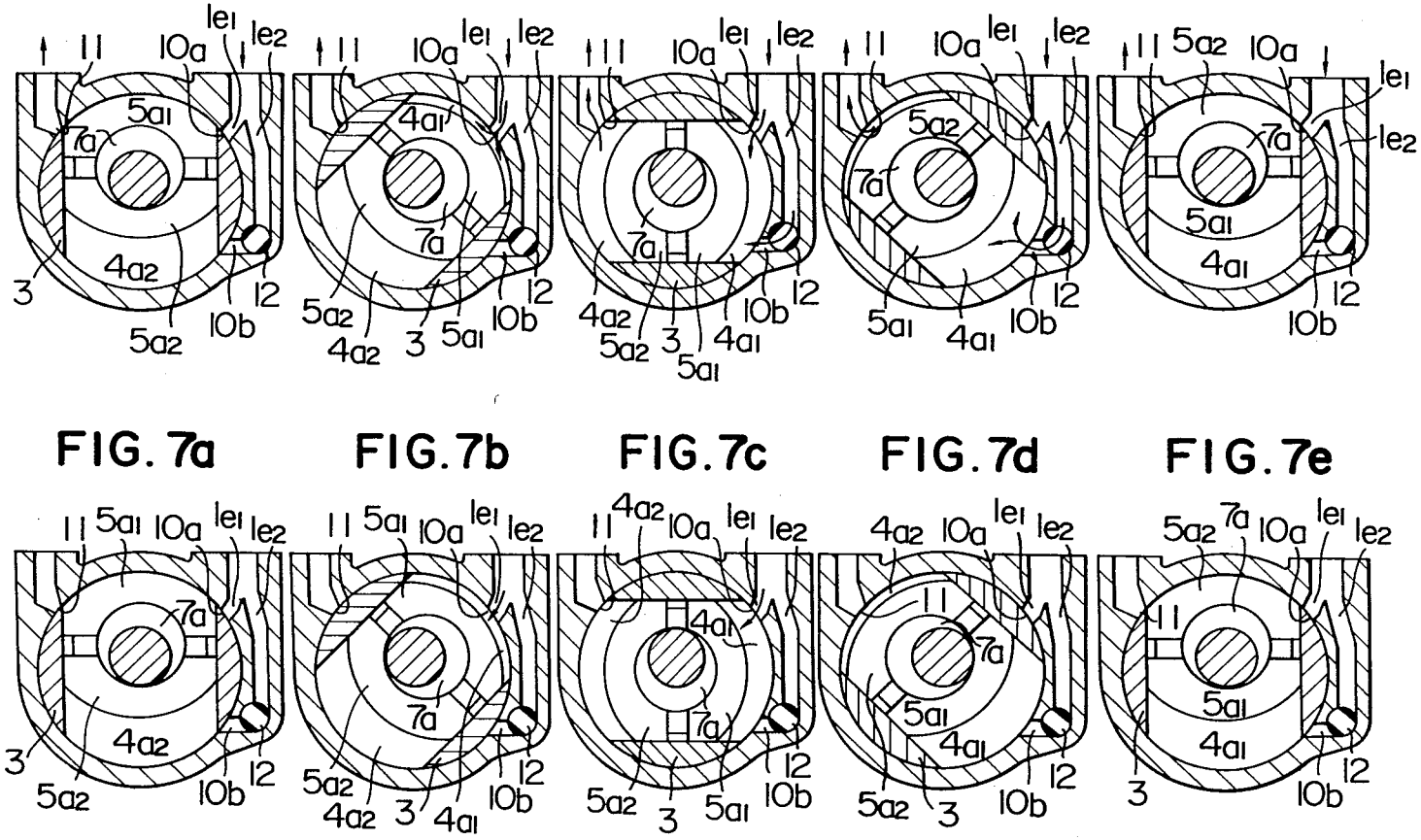
FIGS. 6*a*–6*e* and 7*a*–7*e* are views in explanation of operation of the volume control mechanism according to the invention as incorporated in the compressor shown in FIGS. 1–3.

As the cylinder 3 begins to move clockwise from its position shown in FIGS. 6a, a working chamber $4a_1$is defined between the inner wall surface of the shell 1 and a head of a piston $5a_1$, and the suction port 10a which has up to then been closed by the peripheral surface of the cylinder 3 is brought into communication with the working chamber $4a_1$ which begins to perform a suction stroke.

FIG. 6b shows the cylinder 3 in a position to which it has moved through 45 degrees from its position shown in FIG. 6a.

Rotation of the cylinder 3 through 90 degrees from its position shown in FIG. 6a brings the suction port 10b into communication with the working chamber $4a_1$ as shown in FIG. 6c. Thus, a fluid is drawn by suction through the two suction ports 10a, 10b.

Further rotation of the cylinder 3 closes the suction port 10a by the peripheral surface of the cylinder 3 as shown in FIG. 6d, while leaving the suction port 10b open to draw the fluid by suction therethrough into the working chamber $4a_1$.

Rotation of the cylinder 3 through 180 degrees closes both the suction ports 10a, 10b by the peripheral surface of the cylinder 3, thereby terminating the suction stroke of the working chamber $4a_1$.

Thus, when the on-off control valve 12 is in the open position, the fluid is drawn by suction into a working chamber $4a_1$ through both the suction ports 10a, 10b or only the suction port 10b so long as the working chamber $4a_1$ is in the suction stroke.

Operation of the compressor will be described by referring to FIGS. 7a–7e when the on-off control valve 12 is brought to a closed position to reduce the volume of the fluid discharged from the compressor.

The operation of the compressor is no different from the description made by referring to FIGS. 6a–6e in that rotation of the cylinder 3 brings the working chamber $4a_1$ and suction port 10a into communication with each other to allow the working chamber $4a_1$ to perform a suction stroke.

However, although rotation of the cylinder 3 through 90 degrees brings the suction port 10b to a position in which it faces the working chamber $4a_1$ as shown in FIG. 7c, no fluid is drawn by suction through the suction port 10b into the working chamber $4a_1$ because the passage $1e_2$ is closed by the on-off control valve 12.

Moreover, as further rotation of the cylinder 3 brings the cylinder 3 to a position in which the suction port 10a is closed by its peripheral surface as shown in FIG. 7d, no fluid is drawn by suction into the working chamber $4a_1$ any longer.

If the cylinder 3 continues rotating in this condition, then the fluid trapped in the working chamber $4a_1$ which successively increases volume is subjected to adiabatic expansion.

Following the condition shown in FIG. 7e, the working chamber $4a_1$ enters a compression stroke. However, since the fluid therein has been expanded beforehand, compression of the fluid does not begin until the expansion is removed. Thus, the machine substantially does no work during this period, so that the machine is in a condition of no loss. This is conducive to avoidance of a loss of energy for driving the machine which would be caused to occur if dead work is performed as in the prior art in which volume control is effected by reducing the cross-sectional area of the suction passage.

Figure 8:
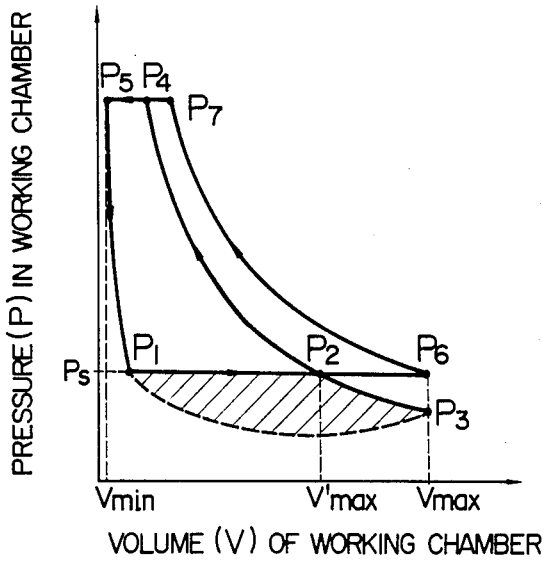
FIG. 8 is a P-V diagram in explanation of the difference between the volume control method according to the invention and a volume control method of the prior art.
Figure 9:
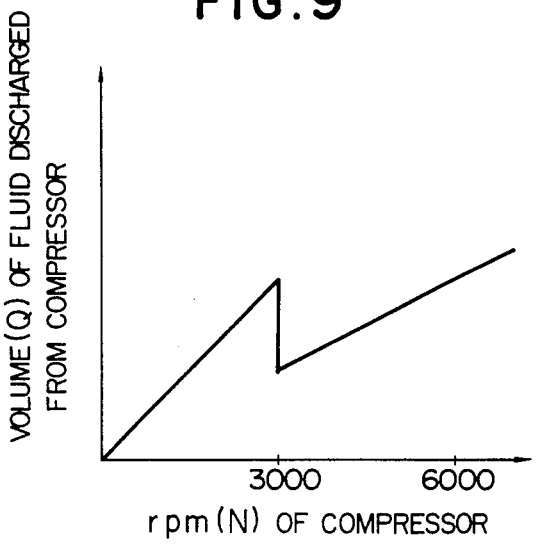
FIG. 9 is a diagrammatic representation of the results of application of the invention in a compressor of an air-conditioning system of an automotive vehicle, showing the relationship between the volume of fluid discharged from the compressor and the rpm of a compressor of the automotive vehicle.

The volume control described hereinabove has a characteristic shown in a P-V diagram in FIG. 8 by a curve $P_1$-$P_2$-$P_3$-$P_2$-$P_4$-$P_5$-$P_1$. Points $P_1$, $P_2$ and $P_3$ represent P-V characteristics of the working chamber $4a_1$ shown in FIGS. 7a, 7c and 7e, respectively. A curve $P_1$-$P_6$-$P_7$-$P_5$-$P_1$ represents the P-V characteristic of the working chamber obtained when no volume control is effected. A curve $P_1$-$P_3$-$P_4$-$P_5$-$P_1$ represents the P-V characteristic of the working chamber when volume control is effected by reducing the cross-sectional area of the suction passage in the prior art. In the diagram shown in FIG. 8, a hatched region indicates dead work done by the volume control of the prior art which requires an additional input of power for driving the machine.

The volume control effected according to the invention has a characteristic such that suction is performed substantially in a condition of $P_s$ up to halfway through the suction stroke and an initial condition (at a point $P_1$) is substantially restored after adiabatic expansion is effected from a point $P_2$ to a point $P_3$ and adiabatic compression is effected from point $P_3$ to $P_2$, followed essentially by a compression stroke performed from point $P_2$ to a point $P_4$. Assume that volume of the working chamber up to point $P_2$ is denoted by $V'_{max}$. Then, the flow rate of a fluid obtained when volume control is effected would be substantially at a ratio of $V'_{max}/V_{max}$.

As described in the background of the invention, when the cross-sectional area of the suction passage is reduced to decrease the flow rate of a fluid into the working chamber, the fluid is heated by the heat generated in the compressor as it is drawn by suction into the working chamber through the suction passage. As a result, an abnormal rise in the temperature of the fluid and in the temperature of the compressor is caused to occur. This disadvantage of the prior art is obviated by the invention because the suction stroke itself is terminated before its full stroke is finished, with a result that, even if the volume of the fluid drawn by suction into the working chamber is reduced, the temperature of the fluid drawn by suction into the working chamber is not effected by the volume control effected by the method according to the invention. Thus, the aforesaid abnormal rise in temperature is avoided.

In the embodiment of the invention described hereinabove, it is possible to effect control of the fluid flowing through the suction passage into the working chambers merely by activating an on-off control valve. This is conducive to a drop in the temperature of the discharged gas and a reduction in the power input for effecting compression. The apparatus suitable for carrying the method according to the invention is simple in construction and low in cost. Thus, the compressor incorporating the invention therein is highly reliable in performance, long in service life and high in fuel efficiency.

In the description of the embodiment set forth hereinabove, the suction port has been described as being switched between different positions stepwise. However, by closing the on-off control valve 12 after suction through the suction port 10b has begun, it is possible to regulate as desired the controlled variable.

The invention is not limited to the aforesaid mode of control of the volume of fluid discharged from the compressor. An additional on-off control valve may be provided for controlling the flow of fluid through the suction port 10a, and the suction ports 10a and 10b may be both closed by the respective on-off control valve while suction of fluid is being carried out through the suction port 10a. This provides a more sophisticated method of volume control.

The application of the invention is not limited to the improved compressor of the construction shown and described hereinabove. It is to be understood that the invention can also have application in other reciprocatory type of compressor, rotary vane type compressor, etc.

Where division of a suction port into a plurality of ports is not feasible, volume control may be effected substantially as in the invention by adjusting the timing with which the on-off control valve mounted in the suction passage is closed, as described hereinabove. In this case, the controlled variable would be reduced as the time at which the valve is closed becomes remote from the point at which the suction stroke is initiated and close to the point at which maximization of the volume of the working chamber is achieved.

The on-off control valve for regulating the flow of a fluid through the suction passage may be driven by an electric motor actuator generally designated by the reference character M (FIGS. 12, 13) or other electrical equipments such as, for example, a solenoid generally designated by the reference character A (FIGS. 14, 15) or a diaphragm actuator generally designated by the reference character A' (FIGS. 16, 17). However, when the invention is incorporated in a compressor of an air conditioning system of an automotive vehicle, a negative pressure actuator generally designated by the reference character N (FIGS. 10, 11) using as a drive source a subatmospheric pressure or negative pressure produced in the suction manifold of an engine generally designated by the reference character E (FIGS. 11–17) may be used. The negative pressure actuator N may be of the type disclosed in, for example, U.S. application Ser. No. 314,036, now U.S. Pat. No. 4,515,066. In the invention, an actuating rod of the negative pressure actuator N may be connected to a link designated by the reference numeral 51 in FIG. 1, which is turned in direction indicated by the arrowheads in FIG. 1 to actuate the on-off control valve located inside the shell 1.

Figure 10:
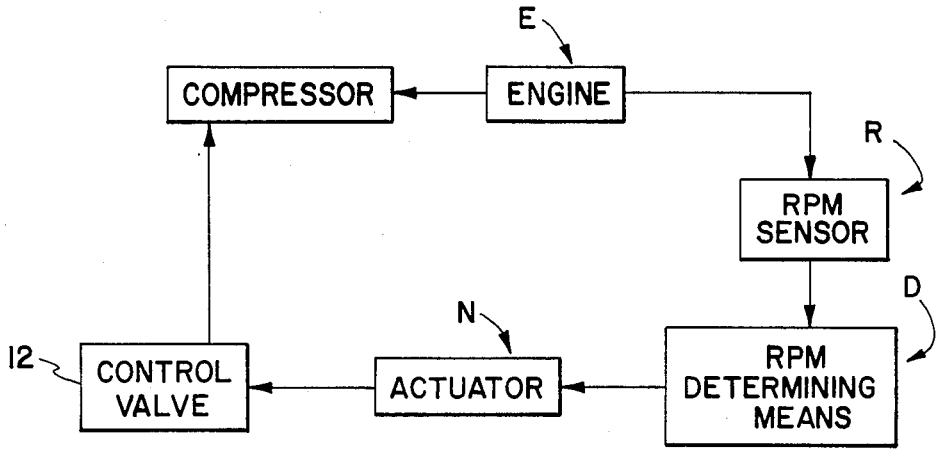
FIG. 10 is a schematic view of an engine driving compressor with a sensor for detecting rotational speed of the engine to control an operation of the compressor.

The time at which the on-off control valve is closed may be decided as desired depending on the operating condition of the compressor. For example, when the invention is incorporated in a compressor of an air-conditioning system of an automotive vehicle which is directly connected to an engine E of the automotive vehicle and driven thereby, the volume of the compressor may become excessive in a range of high rpm of the engine E. In this case as shown in FIG. 10, volume control may be effected by sensing the engine rpm by a RPM sensor generally designated by the reference character R (FIGS. 10, 12, 14, 16) and closing the on-off control valve 12 when a predetermined engine rotational speed (3000 rpm in the embodiment) is exceeded.

In the embodiment described hereinabove, control signals of an ignition system are smoothed to obtain a voltage proportional to the engine rpm, although not shown, which is inputted to a microcomputer or RPM determining means generally designated by the reference character to determine the magnitude of the engine rotational speed. When the rpm is found to be over 3000 rpm, the solenoid of the negative pressure actuator described hereinabove is energized by an output of the microcomputer to introduce a negative pressure into the actuator to enable the actuating rod to actuate the link 51, to thereby close the on-off control valve 12.

Figure 11:
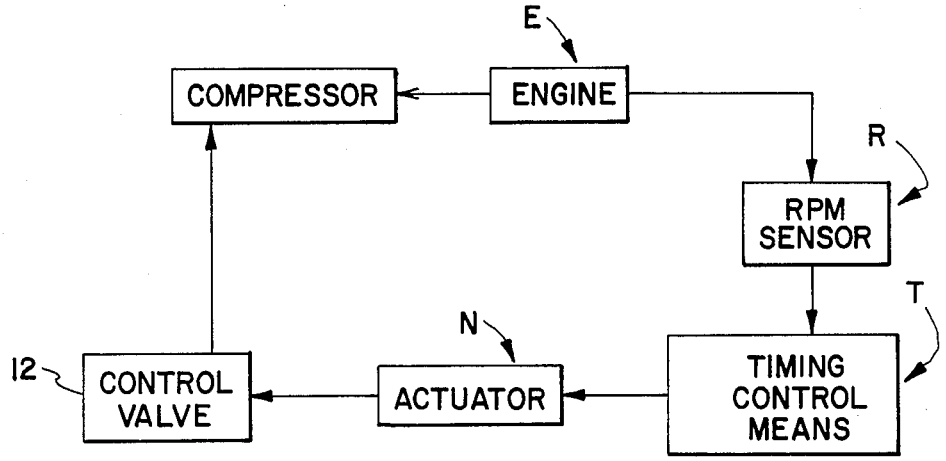
FIG. 11 is a schematic view of an engine driving compressor with a timing control means for controlling an operation of the compressor.

When, as shown in FIG. 11, volume control is effected by controlling the time at which the on-off control valve 12 is closed, linear volume control can be effected with respect to the engine rotational speed by providing timing control means generally designated by the reference character T for advancing the time toward the suction initiation side as the rotational speed increases. In the compressor in which the present embodiment is incorporated, the cylinder 3 makes one complete revolution when the shaft 7 makes two complete revolutions, to cause the piston **5*a* to make one reciprocatory movement through the bore 4*a*. Thus, the cylinder 3 rotates at an angular velocity which is one-half that of the shaft 7 to actuate the piston 5*a*** to make one reciprocatory movement.

This means that, if the shaft 7 is rotated at twice the rotational speed of a shaft of a compressor of the prior art, then a drive torque for rotating the shaft 7 or work done for achieving one complete revolution of the shaft 7 is reduced by one-half, so that it is possible to use a prime mover of a high speed type. This makes it possible to use a compact prime mover.

When the invention is applied to a compressor constituting the refrigeration cycle of an air-conditioning system of an automotive vehicle, a V-belt and pulleys are used for transmitting the rotational force of the engine E to the compressor. If it is desired to rotate the shaft of the compressor at a speed twice the speed at which it is usually rotated, it is necessary to increase the pulley ratio. This means that the diameter of the pulley on the compressor side can be reduced, making it possible to obtain a compact overall size in a rotational power transmission.

The shaft of the compressor has an electromagnetic clutch located at an input end thereof so as to interrupt the transmission of rotational force of the engine E to the compressor by actuating the clutch. As the drive torque for rotating the shaft of the compressor can be reduced as described hereinabove, a shearing torque exerted on the friction surface by the clutch can also be reduced. This means that the electromagnetic attracting force exerted by the clutch may be low in magnitude. As a result, it is possible to reduce the electromagnetic device and friction plates in size to obtain the desired electromagnetic attracting force. The pulley referred to hereinabove is located in the electromagnetic clutch, so that a reduction in the size of the pulley leads to a reduction in the size of the electromagnetic device and friction plates, thereby enabling a compact overall size to be obtained in a rotational power transmission or electromagnetic clutch.

The embodiment shown and described hereinabove is constructed such that the working chamber is kept out of communication with the discharge port until the cylinder has rotated substantially through 90 degrees from the position in which the working chamber has its volume maximized. This is for the purpose of compressing the fluid at a predetermined compression ratio. Thus, the position in which the working chamber is brought into communication with the suction port may be decided as desired depending on the compression ratio.

The displacement of the piston **5*a* (5*b*) is four times as great as the eccentricity S of the cam 7*a* (7*b***). In a crank mechanism of a compressor having a reciprocatory piston of the prior art, the displacement of the piston is twice as great as the eccentricity of the crank-shaft and crank-pin (corresponding to the cams of the invention). Thus, the piston according to the invention can have a stroke which is twice as great as the stroke of the piston of the prior art.

In the embodiment described hereinabove, the peripheral surface of the cylinder 3 keeps the discharge port closed until the cylinder bore rotates to the position in which the discharge port is located. Stated differently, the cylinder has the function of a discharge valve, and the need to provide a discharge valve is eliminated. The compression ratio can be decided as desired by suitably selecting the position in which the discharge port opens and the diameter of the discharge port.

When the volume control according to the invention is incorporated in a compressor of an air-conditioning system, the on-off control valve for controlling the flow of a fluid may be closed or the time at which the valve is closed may be controlled depending on the magnitude of a thermal load applied to the compressor.

From the foregoing description, it will be appreciated that, according to the invention, the suction passage is closed while a suction stroke is being followed by the compressor and a fluid drawn up to then by suction into the working chamber is subjected to adiabatic expansion therein until the volume of the working chamber is maximized, and thereafter the fluid is compressed to achieve a predetermined pressure. Thus, the compressor essentially does not need to do work while the on-off control valve remains closed. This is conducive to a reduction in the input of power to the compressor and an increased in the energy efficiency with which volume control is effected. After the on-off control valve is closed, the fluid is kept from entering the working chamber. Thus, the heat generated by the compressor itself is kept from being introduced into the working chamber along with the fluid, and a rise in the temperature of the fluid discharged from the compressor is avoided when volume control is effected.

What is claimed is:

1. A compressor including a controlling apparatus for controlling a volume of a fluid discharge from the compressor after being compressed, the controlling apparatus comprising:

an on-off control valve mounted in a fluid suction passage communicating a refrigerant suction port of the compressor alternately with one of a plurality of working chambers; and valve closing means for bringing said on-off control valve to a closed position to interrupt the flow of a fluid through said fluid suction passage to the working chamber, when it is necessary to effect volume control, while the working chamber is in a suction stroke and before the volume of the working chamber is maximized, said valve closing means including a cylinder rotatable in a shell, a bore formed in said cylinder, a piston slidably fitted in said bore, a rotatable drive means for rotating said cylinder in said shell, and for reciprocating said piston in said bore, a working chamber defined by a head of said piston, an inner wall of said shell and the wall of said bore, in which the volume thereof increases and decreases according to a rotation of said cylinder, a first suction passage in communication with said working chamber in a former half of the suction stroke, and a second suction passage sealed by a portion of the peripheral wall of said cylinder while said first suction passage is in communication with said working chamber, and in communication with said working chamber in a latter half of the suction stroke in which said first suction passage is sealed by another part of said cylinder, and wherein said on-off control valve of said controlling apparatus is formed by an on-off control valve mounted in said second suction passage.

2. A compressor as claimed in claim 1, wherein said valve closing means comprises valve closing timing varying means for varying the time with which the on-off control valve is closed depending on the operation condition of the compressor.

3. A compressor as claimed in claim 1, wherein the compressor is driven by an engine of a motor vehicle, and said valve closing means comprises an rpm sensor for monitoring the rpm of the engine of the motor vehicle, rpm determining means for producing an output signal when the rpm of the engine exceeds a predetermined value, and an actuator for bringing the on-off control valve to a closed position when the output signal is produced by the rpm determining means.

4. A compressor as claimed in claim 1, wherein the compressor is driven by an engine of a motor vehicle, and said valve closing means comprises an rpm sensor for monitoring the rpm of the engine of the motor vehicle, a valve closing timing control for controlling the timing with which said on-off control valve is closed based on an output of said rpm sensor, and an actuator for bringing the on-off control valve to a closed position when an output is produced by said valve closing timing control.

5. A compressor as claimed in one of claims 3 or 4, wherein the actuator is a motor.

6. A compressor as claimed in one of claims 3 or 4, wherein said actuator is an electromagnetic solenoid.

7. A compressor as claimed in one of claims 3 or 4, wherein said actuator is a diaphragm actuator using as a source of a driving force a negative pressure produced in a suction conduit of the engine.

8. A compressor as claimed in claim 1, wherein a surface of an opening of a suction port to a working chamber is a stationary wall surface.

9. A compressor as claimed in claim 8, wherein a sealing portion of the surface is greater in size than the size of the suction port.

10. A compressor as claimed in claim 3, wherein said first and second suction passages are each provided with a suction port formed in said shell and opening to said closed space, and said cylinder has an outer surface having a dimension sufficient to close said first and second ports simultaneously.

* * * * *